US009343790B2

(12) United States Patent
Ruiz-Cruz et al.

(10) Patent No.: US 9,343,790 B2
(45) Date of Patent: May 17, 2016

(54) METHOD OF OPERATION AND CONSTRUCTION OF FILTERS AND MULTIPLEXERS USING MULTI-CONDUCTOR MULTI-DIELECTRIC COMBLINE RESONATORS

(71) Applicants: Jorge A. Ruiz-Cruz, Madrid (ES); Mohamed M. Fahmi, Oakville (CA); Raafat R. Mansour, Waterloo (CA)

(72) Inventors: Jorge A. Ruiz-Cruz, Madrid (ES); Mohamed M. Fahmi, Oakville (CA); Raafat R. Mansour, Waterloo (CA)

( * ) Notice: Subject to any disclaimer, the term of this patent is extended or adjusted under 35 U.S.C. 154(b) by 368 days.

(21) Appl. No.: 13/902,911

(22) Filed: May 27, 2013

(65) Prior Publication Data

US 2014/0347148 A1 Nov. 27, 2014

(51) Int. Cl.
*H01P 1/202* (2006.01)
*H01P 1/205* (2006.01)

(52) U.S. Cl.
CPC ..... *H01P 1/2053* (2013.01); *H01P 1/205* (2013.01)

(58) Field of Classification Search
CPC .... H01P 1/2086; H01P 1/2053; H01P 1/2082
USPC ..... 333/206, 207, 212, 134
See application file for complete search history.

(56) References Cited

U.S. PATENT DOCUMENTS

| | | | | |
|---|---|---|---|---|
| 4,453,146 | A * | 6/1984 | Fiedziuszko | 333/212 |
| 4,794,354 | A * | 12/1988 | Dinsmore et al. | 333/207 |
| 6,664,872 | B2 | 12/2003 | Channabasappa et al. | |
| 2008/0246561 | A1 * | 10/2008 | Blair et al. | 333/212 |
| 2010/0013578 | A1 * | 1/2010 | Memarian et al. | 333/219.1 |
| 2012/0119850 | A1 | 5/2012 | Pari et al. | |

* cited by examiner

*Primary Examiner* — Stephen E Jones
(74) *Attorney, Agent, or Firm* — Nasser Ashgriz; UIPatent Inc.

(57) ABSTRACT

This invention provides novel combline resonators with multiple conductors and multiple dielectrics for compact filters and multiplexers with improved electric response. The novel combline resonator consists of multi-conductors being made up for the simplest case of an inner metallic post, an intermediate conductor, and an enclosure. This structure provides two resonant modes that can be used for realizing compact microwave filters and multiplexers. Such filters offer the low cost, compact size and ease of manufacturing features of traditional combline resonator filters, with additional size reduction due to the fact that a single physical cavity provides two electrical resonators. In addition, the new cavity inherently introduces a transmission zero in the guard-bands enhancing the filter selectivity.

16 Claims, 18 Drawing Sheets

(a) (b)

(a)

(b)

METHOD OF OPERATION AND CONSTRUCTION OF FILTERS AND MULTIPLEXERS USING MULTI-CONDUCTOR MULTI-DIELECTRIC COMBLINE RESONATORS

FIELD OF THE INVENTION

The present invention is related to microwave filters and multiplexers used in antenna feeders and radio-frequency/microwave transceiver systems.

BACKGROUND OF THE INVENTION

Combline filters have been used in the telecommunication industry for many decades. One of the most common types of filters for RF and microwave applications are combline filters. In particular, they are used in wireless base station applications because they offer low production cost and a relatively high unloaded quality factor (Qu). A combline filter consists of cavity resonators coupled to each other. In a conventional combline filter, each cavity has a single resonant TEM mode supported by two conductors, typically a metal bar of a square or circular cross-section is surrounded by a metallic enclosure. Cavities with more than one resonant mode can be used in dual-band and multiple-band filters. In conventional transceiver architectures, the use of different frequency bands leads to dedicated signal paths for each service requiring the use of a filter for each frequency band, which in turn results in more volume, mass, and, eventually, higher cost. To overcome these drawbacks, several transceiver architectures with dual (and multiple) band filters have been proposed for simplification of system architecture in different contexts. A dual band filter has one input and one output with two pass bands. The use of such type of filters eliminates the use of two filters and two combining networks at the input and output.

The present invention uses a new configuration of combline resonators employing multiple conductors and/or multiple dielectrics with more than one resonant mode per cavity. They are used in realizing compact filters and multiplexers with improved electric-response characteristics for modern telecommunication system applications with multiple services and several frequency bands.

SUMMARY OF THE INVENTION

The development of multiple services and the need of using several frequency bands with more flexibility have triggered the demand for advanced filters and multiplexers to further improve the RF/microwave front ends. The present invention uses a new configuration of combline resonators using multiple conductors and multiple dielectrics for obtaining filters and multiplexers with improved characteristics.

The resonators of this invention can be used in several applications, all sharing (a) the so called combline structure with additional multiple conductors and/or multiple-dielectrics, and (b) the use of more than one mode per individual cavity, with different electromagnetic field patterns and well defined resonant frequencies to operate in dual-mode or in dual-band.

The first embodiment described herein provides a combline which has been modified by adding a third conductor. In the simpler version of the present invention, the novel combline resonator has an inner metal rod or post surrounded by an intermediate metallic conductor and a metallic enclosure, providing two resonant modes.

The second embodiment described herein provides a novel combline resonator wherein the inner post is metallic and the intermediate conductor is dielectric.

The third embodiment described herein provides a novel combline resonator wherein the inner post is dielectric and the intermediate conductor is metallic.

The fourth embodiment described herein provides a novel combline resonator wherein the inner post is dielectric and the intermediate conductor is also dielectric made of the same or from a different dielectric material.

The first objective of the present invention is to provide a compact multi-mode resonator. The second objective of the present invention is to provide a triple-conductor combline resonator. The third objective of the present invention is to make the number of cavities used less than the total order of the filters as compared to those used in conventional dual-band filter designs. The fourth objective of the present invention is to enhance the guard-band selectivity by means of the transmission zeros (frequency points at which transmission of energy between input and output is totally suppressed) between the pass-bands inherent to the structure of the present invention. The fifth objective of the present invention is to provide a dual-band filter, where mode 1 in each cavity is resonating in lower pass-band and mode 2 in each cavity is resonating in the upper pass-band.

The aforementioned objects of the present invention are attained by multi-conductor multi-dielectric combline resonators with more than one electrical resonant mode per physical cavity. Other objects, advantages and novel features of the present invention will become readily apparent from the following drawings and detailed description of preferred embodiments.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

FIG. 12(*b*) illustrates three separate parts (bottom, enclosure and cover) that are assembled together to construct the filter;

DETAILED DESCRIPTION OF THE DRAWINGS

Figure 1:
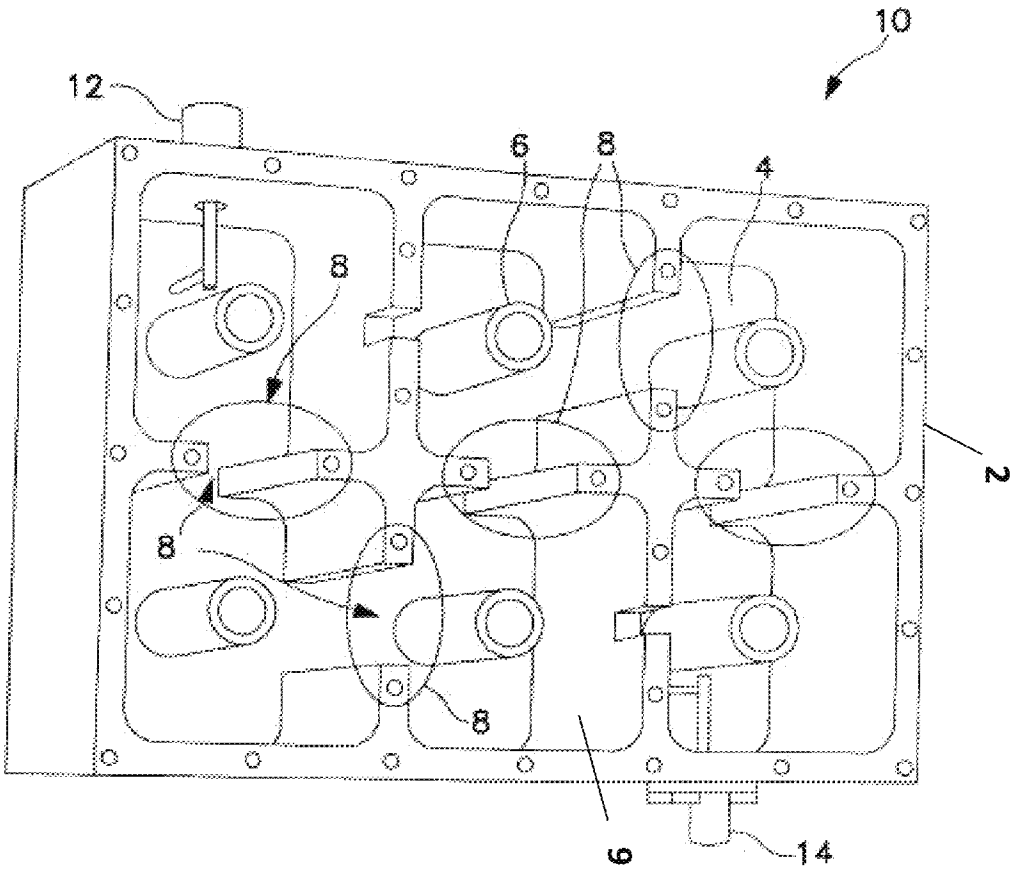
Prior Art FIG. 1
FIG. 1 shows a single band conventional combline filter employing conventional combline cavities operating in a single mode (Prior art in U.S. Pat. No. 6,664,872 B2)

FIG. 1 shows a single-band microwave filter 10 with six cavities 4 (prior art in U.S. Pat. No. 6,664,872 B2). Each cavity 4 operates in a single resonant mode. It consists of one conductor rod 6 whose length is approximately a quarter of the wavelength at the center frequency of the filter 10 and an enclosure 2. The conductor rod 6 is not touching the cover (not shown in the figure). The input port 12 and output port 14 are also shown. The dielectric 9 is air. The metal housing 2 has the cavities 4 separated by walls 2; some windows 8 are used to control the coupling between the resonators 6.

Figure 2:
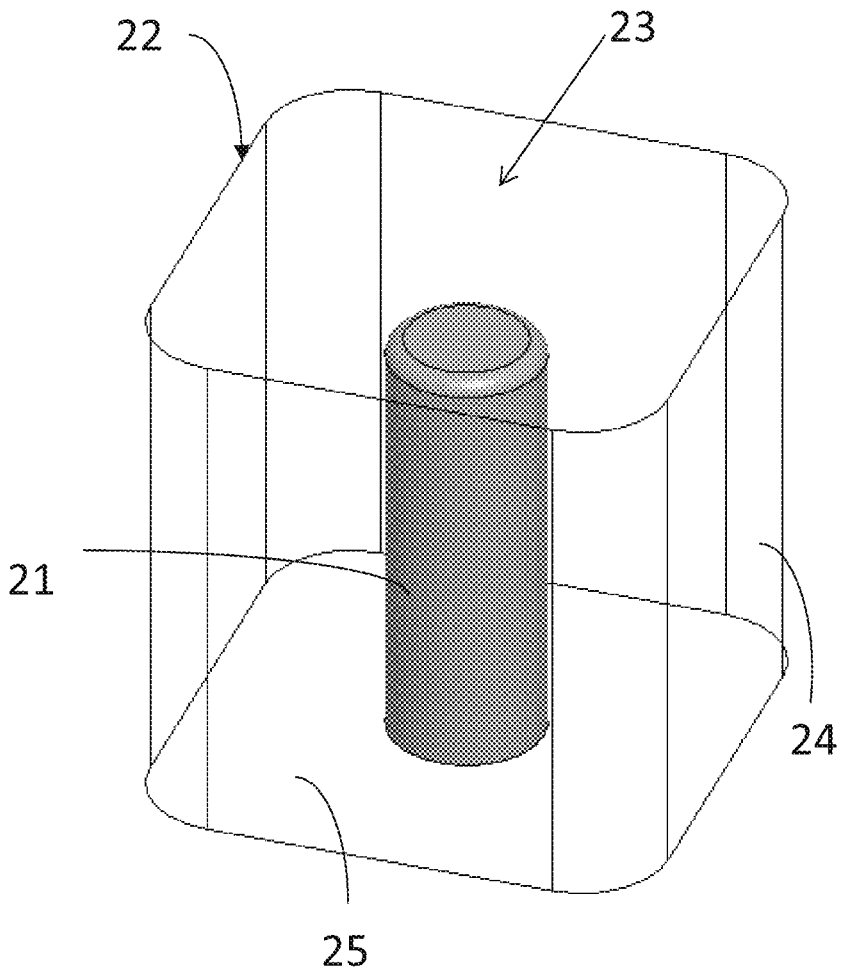
Prior Art FIG. 2
FIG. 2 shows the cross-section and the three-dimensional view of a conventional combline resonator operating in a single mode (Prior art)

FIG. 2 shows the three-dimensional view of a conventional combline resonator which is used in varieties of prior art. In traditional filters, a uniform metallic rod 21 is placed within a metal enclosure 22 which provides a cavity 23 separated by four side walls 24, a bottom wall 25 and a top wall (not shown). The metallic rod 21 is connected to the enclosure 22 from the bottom wall 25, and it is not connected to the top wall. This pattern applies for plurality of rods for combline filters.

Figure 3:
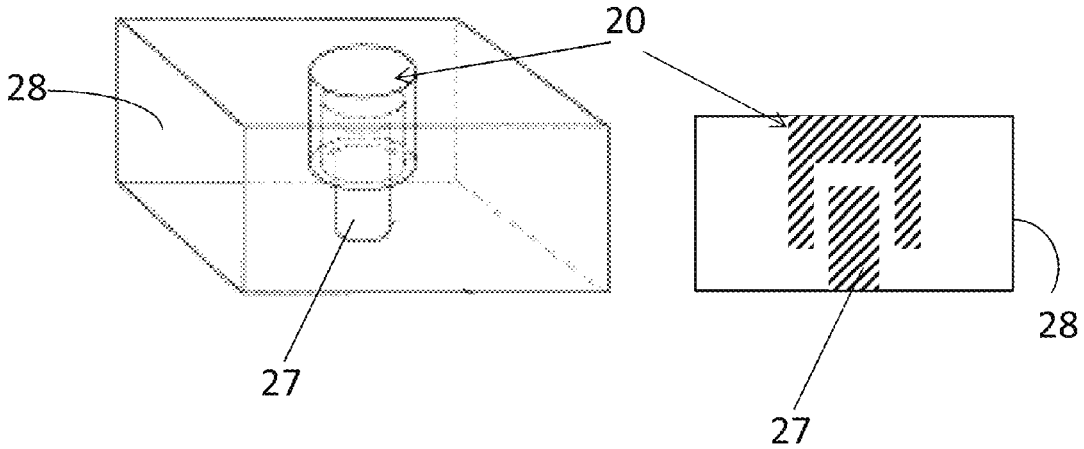
Prior Art FIG. 3
FIG. 3 shows a three-dimensional view and cross-section view of a conventional reentrant combline resonator operating in a single mode (Prior art in Wu et. al, IMS-96, pp. 1639-1642, vol. 3, June 1996)

FIGS. 3(*a*)-3(*b*) show a three-dimensional view and cross-section view of a reentrant combline resonator operating in a single-mode (prior art found in Ke-Li Wu, R. R. Mansour, and H. Wang, "A full wave analysis of a conductor post insert reentrant coaxial resonator in rectangular waveguide combline filters," IEEE MTT-S International Microwave Symposium Digest, 1996., pp. 1639-1642, vol. 3, June 1996). The objective of the top cap 20 is to increase the capacitance between the rod 27 and the enclosure 28, which in turn helps in reducing the cavity size. Such cavity is used in realization of single-band filters.

Figure 4:
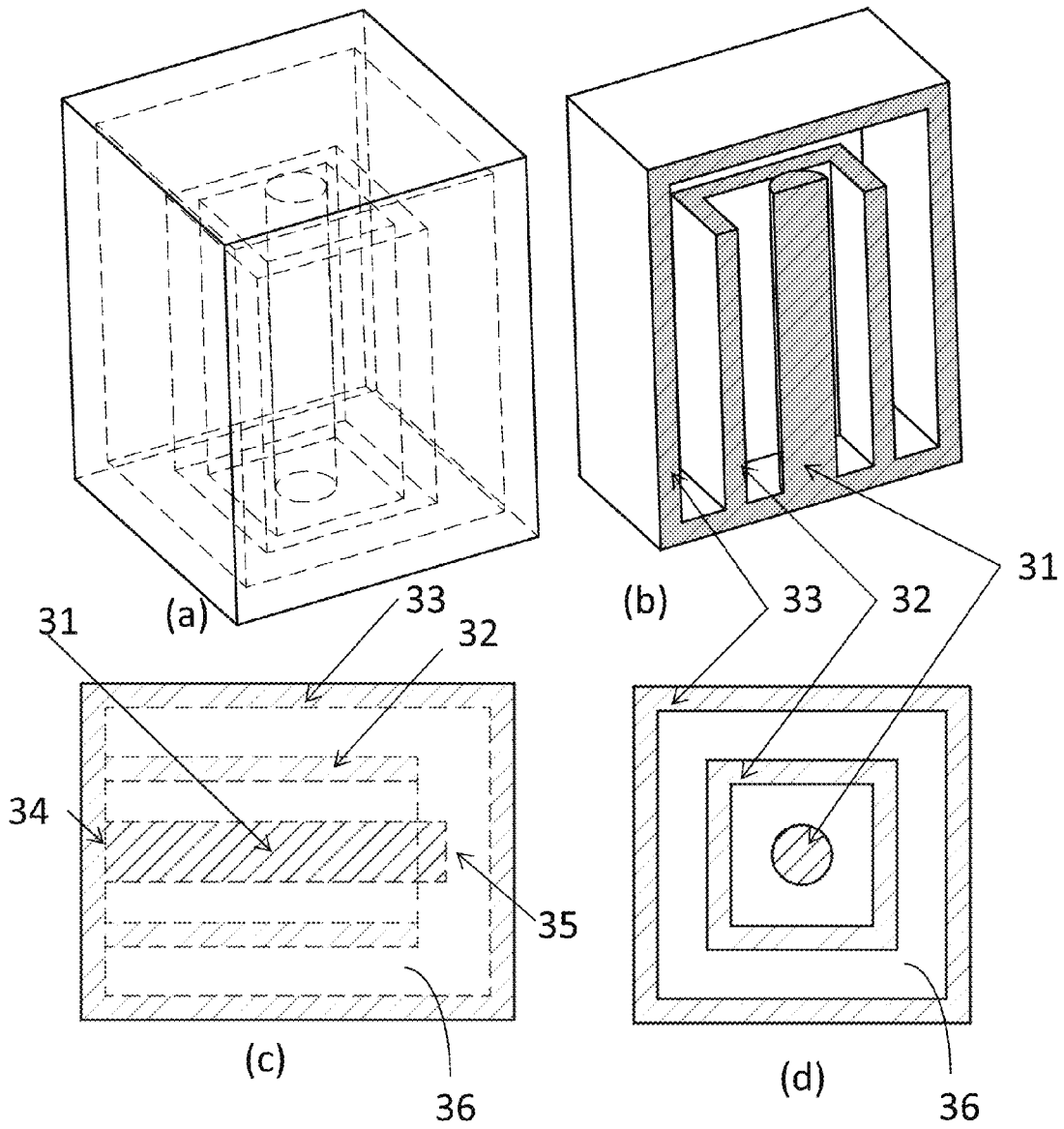
FIGS. 4(*a*)-4(*d*) show various views of the three-conductor combline resonator based on the first embodiment of the present invention.

FIGS. 4(*a*)-4(*d*) illustrate various views of a multi-conductor cavity according to the first preferred embodiment of the present invention. The introduced combline resonator is made up of three metallic conductors: inner post or rod 31, intermediate conductor 32, and enclosure 33. The intermediate conductor 32 and the enclosure 33 are square in this embodiment, but they may have other shapes. The inner post 31 and the intermediate conductor 32 are both short-circuited with the enclosure 33 at one end 34, and open-ended at the other end 35. Their lengths usually differ slightly in order to control the resonant frequencies of the two resonant modes provided by the structure to suite their use in microwave dual-band and dual-mode filters. The third conductor 32 in the novel combline resonator is short circuited at the same end of the inner conductor 31. This structure produces two distinct resonant modes with resonant frequencies close to each other within the same mechanical cavity 36.

Figure 5:
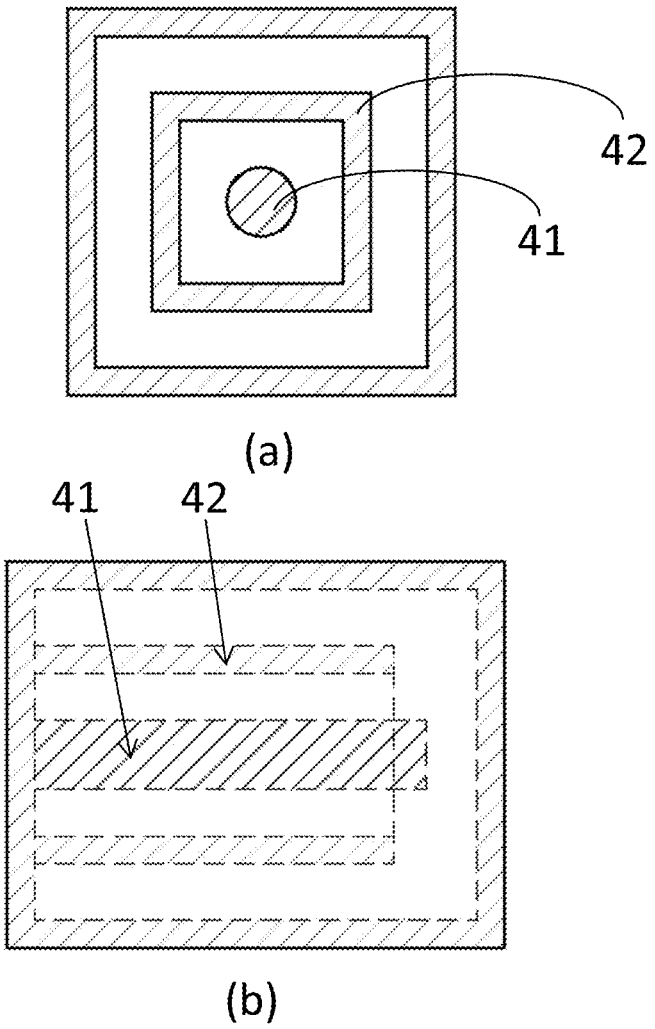
FIGS. 5(*a*)-5(*b*) show various views of the present combline according to the first embodiment wherein the inner conductor is longer than the intermediate conductor.

FIGS. 5(*a*)-5(*b*) show various views of the novel combline according to the first embodiment, wherein the inner conductor 41 is longer than the intermediate conductor 42.

Figure 6:
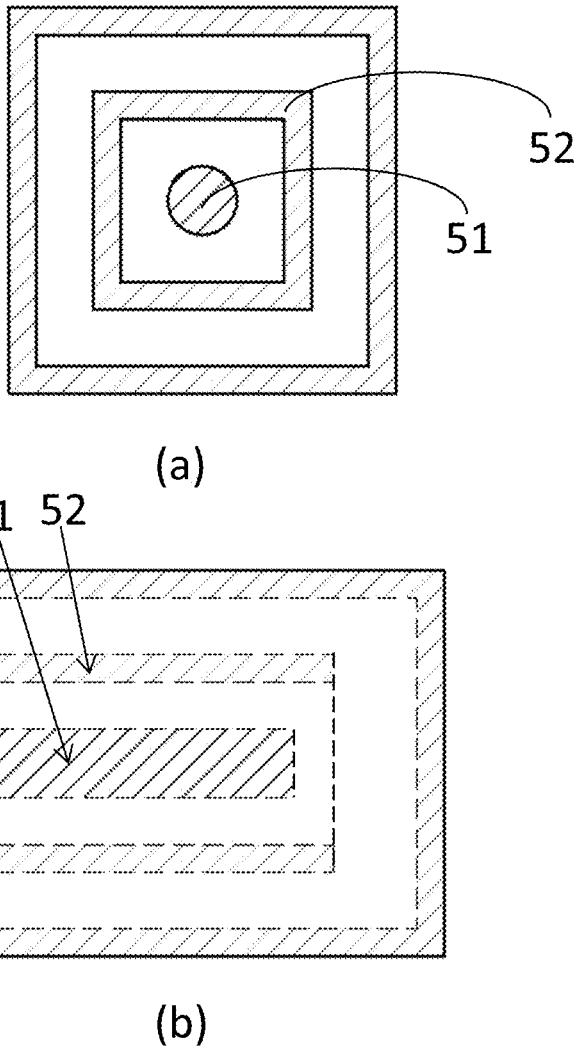
FIGS. 6(*a*)-6(*b*) show various views of the novel combline according to the first embodiment wherein the inner conductor is shorter than the intermediate conductor.

FIGS. 6(*a*)-6(*b*) show various views of the novel combline according to the first embodiment, wherein the inner conductor 51 is shorter than the intermediate conductor 52.

The relative field intensities inside the resonator are dependent on the relative length of the inner post and the intermediate conductor. Thus, the relative length of the conductors and the separation between them provide a mechanism of controlling the distribution of the field in the outer and internal regions. This is crucial for using the resonator in filter designs, since this provides the means to couple resonant modes between adjacent cavities.

In another embodiment of the present invention, an inner post has a means to adjust its height. Any type of height adjusting means can be used. One type is a threaded end at the inner post that is inserted into the bottom of an enclosure. The inner post also can be connected to the bottom of an enclosure by a telescopic rod or alike.

Figure 7:
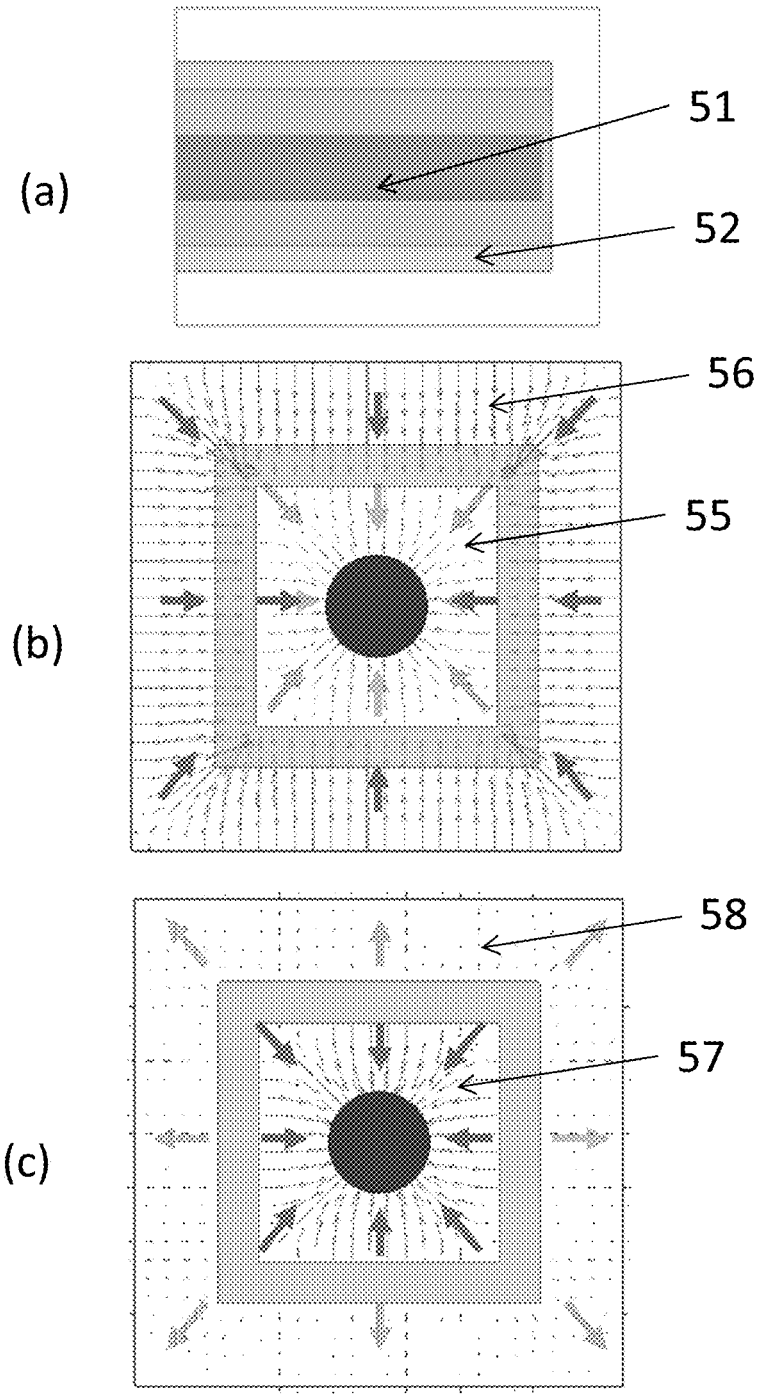
FIGS. 7(*a*)-7(*c*) show the side view and cross section view of the combline resonator of the present invention with the electric field pattern inside, for the first and second resonant modes, when the inner conductor is shorter than the intermediate conductor.

FIG. 7 shows the longitudinal view and cross section with the electric field pattern inside the combline resonator of the present invention, for the first and second resonant modes, when the inner conductor 51 is shorter than the intermediate conductor 52. The field of mode 1, FIG. 7(*b*) points in the same direction in regions 55 and 56. On the other hand, the field of mode 2, FIG. 7(*c*) in region (57) points in the opposite direction to that in region (58). It is also noted that the electromagnetic field of mode 2, FIG. 7(*c*) is mostly confined in the internal region (57), with a very weak field in region (58).

Figure 8:
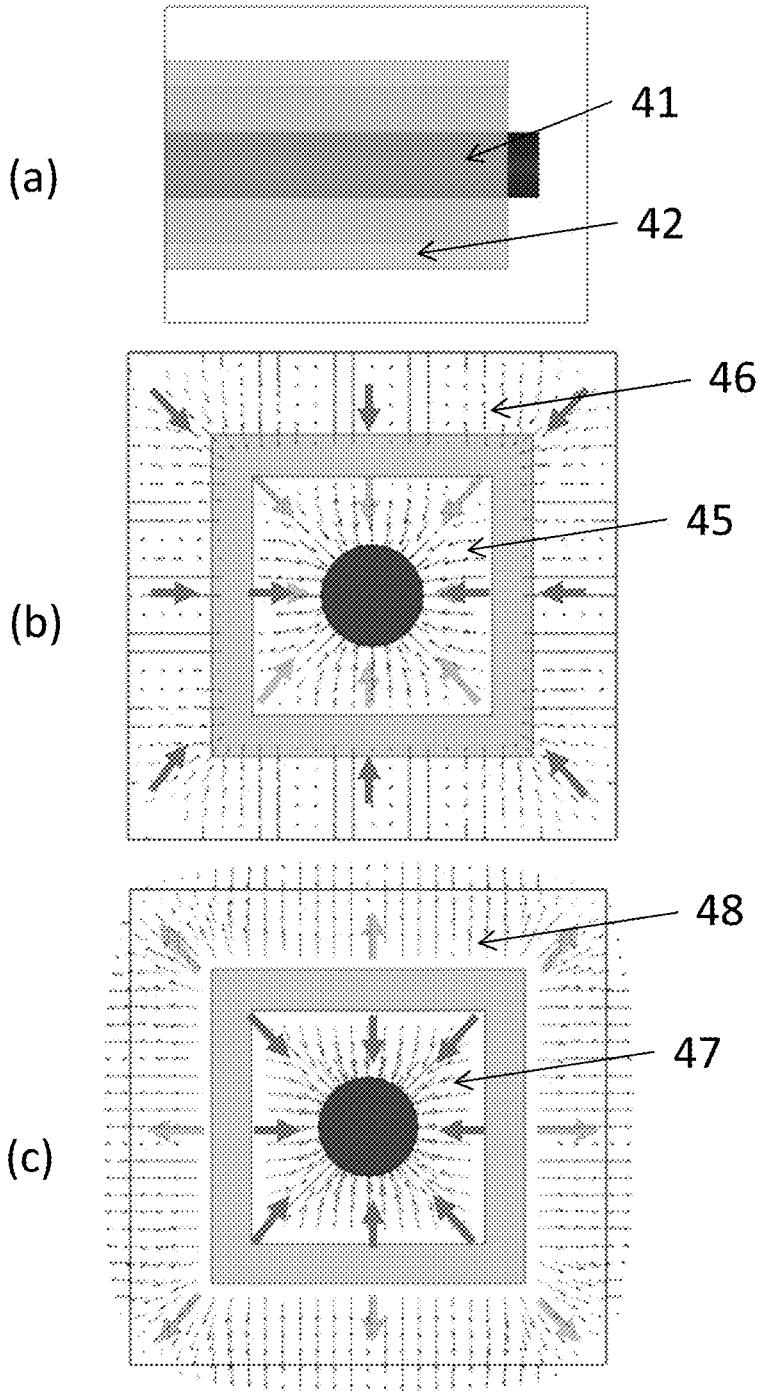
FIGS. 8(*a*)-8(*c*) show the side view and cross section view of the combline resonator of the present invention with the electric field pattern inside, for the first and second resonant mode, when the inner conductor is longer than the intermediate conductor.

FIG. 8 shows the longitudinal view and cross section with the electric field pattern inside the combline resonator of the present invention, for the first and second resonant modes, when the inner conductor 41 is longer than the intermediate conductor 42. The field of mode 1, FIG. 8(*b*) points in the same direction in regions 45 and 46. The field of mode 2, FIG. 8(*c*) in region 47 points in the opposite direction to that in region 48. However, it is noted in this case that the electromagnetic field of mode 2, FIG. 8(*c*) is not confined in the internal region (47). There is also a strong field in region (48).

Figure 9:
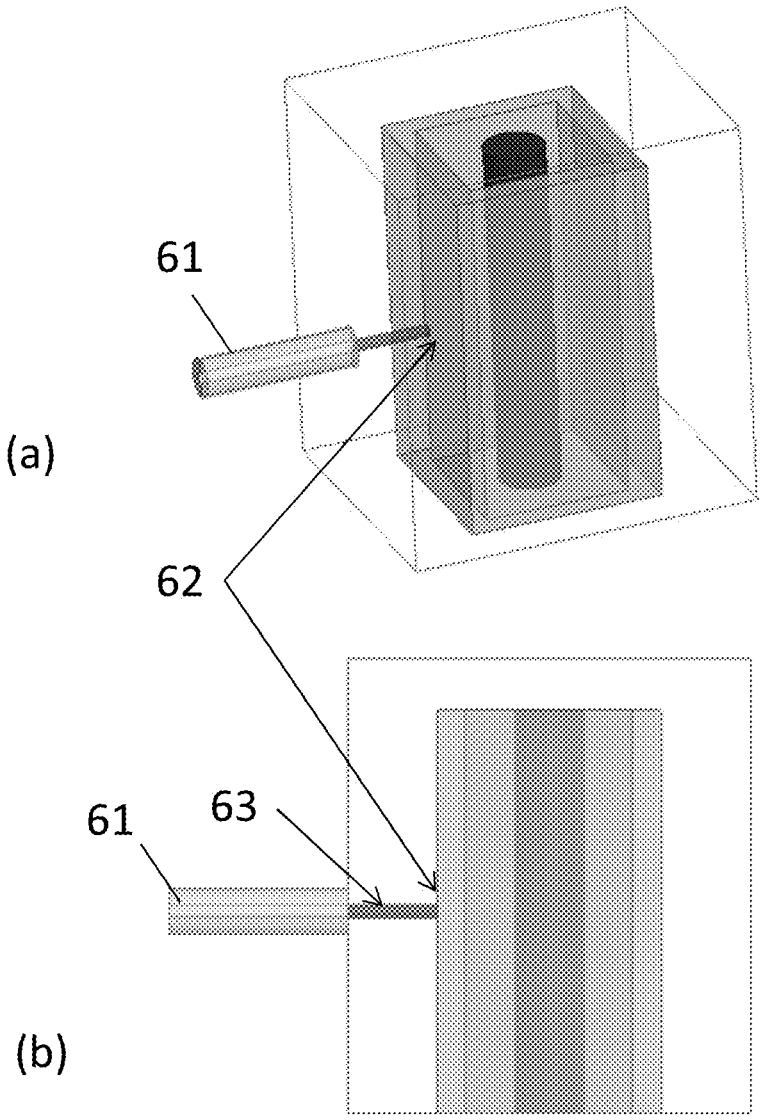
FIGS. 9(*a*)-9(*b*) show a three-dimensional view and a side view of the structure to couple energy from a coaxial cable/feed line to the first and second resonant modes of the combline resonator of the present invention by tapping-in the centre conductor of the coaxial feed line to the intermediate conductor.

FIGS. 9(*a*)-9(*b*) show a three-dimensional view and a side view of the structure to couple energy from a coaxial cable/feed line 61 to the first and second resonant modes of the combline resonator of the present invention by tapping-in the centre conductor 63 of the coaxial feed line to the intermediate conductor 62. This structure can be used in filters and multiplexers for the input/output coupling. This configuration provides enough degrees of freedom to realize different ranges and variations of the input coupling to both resonant modes. The design variables to couple the energy from the coaxial cable/feed line 61 as required in filters, are the length of the probe 61 and the tap-in height with respect to the bottom.

Figure 10:
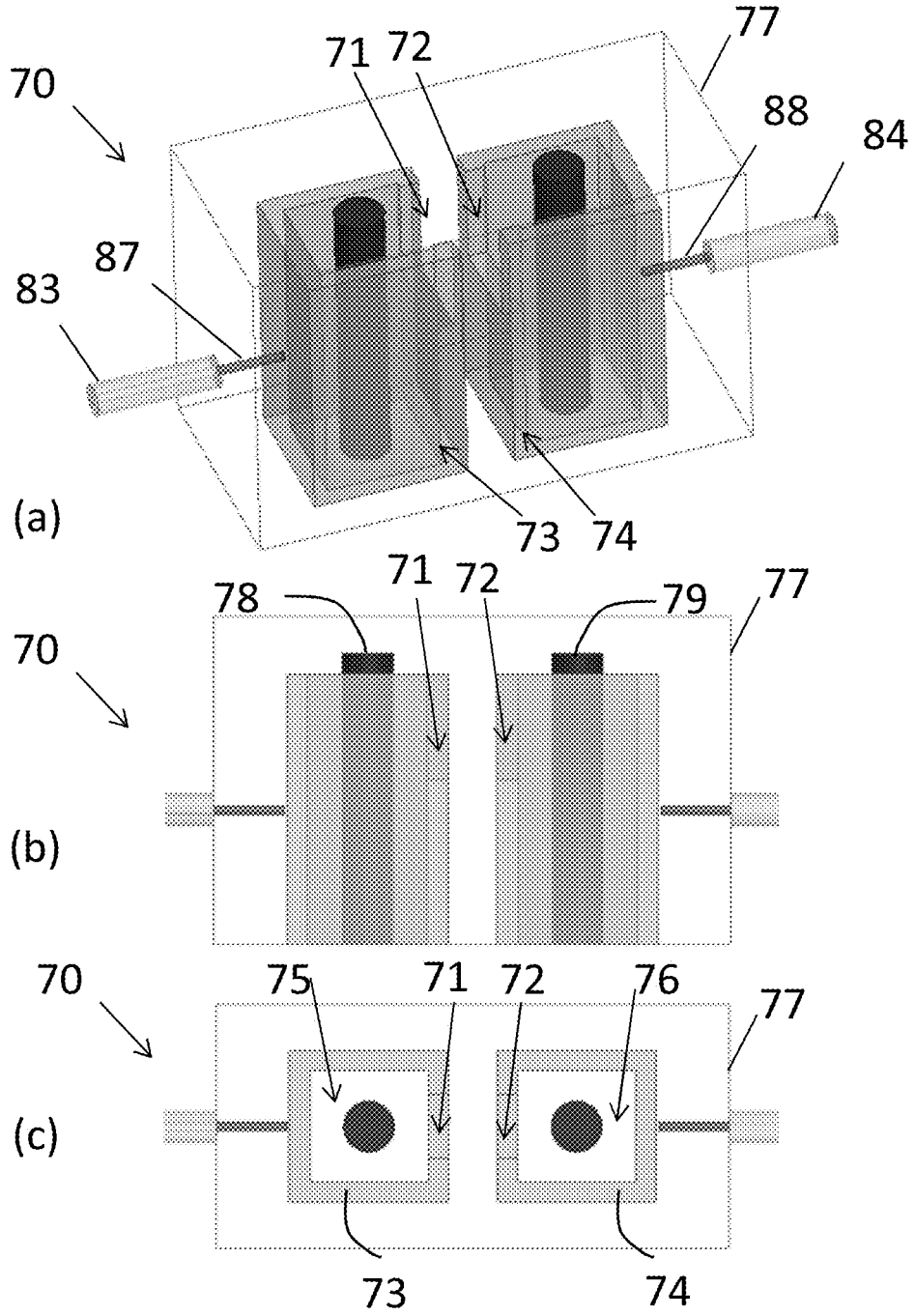
FIGS. 10(*a*)-10(*c*) show various views of two multi-conductor adjacent cavities coupled to together to form a $2^{nd}$ order dual-band filter. The coupling of energy between the first and second resonant modes of one cavity to the first and second resonant modes of the adjacent cavity is controlled by adjusting the space and the windows opened at the intermediate conductors of each cavity.

FIGS. 10 (*a*)-(*c*) show a three-dimensional view, a side view and a top view of $2^{nd}$ order dual band filter illustrating a technique for coupling of energy between the first and second resonant modes of one cavity of the filter according to the first embodiment of the present invention to the first and second resonant modes of an adjacent cavity. The coupling is provided by windows 71, 72 opened at the intermediate conductors 73, 74 of each cavity 75, 76 and by controlling the spacing/distance between the two cavities 75, 76.

As shown in FIG. 10, the combline filter 70 comprises of an enclosure 77 which itself has two cavities 75, 76, two intermediate walls 73, 74, two metallic rods 78, 79, and input and output terminals 83, 83. Once the input and output terminals 83 and 84 are disposed on the outer surface of the enclosure 77, they get connected to intermediate walls 73, 74, for inductively coupling electromagnetic signals. When electromagnetic signals are implemented in the input terminal 83, these input signals are inductively coupled to the first resonator 78 by the loop 87. Subsequently, the two resonant modes (per cavity, four in the whole filter 701) provided by the intermediate conductors 73 (74) and metallic rods 78,(79) resonate in a way that leads to passing certain frequencies of the input signals. The output filtered signals from the last cavity are inductively coupled to the output terminal 84 by loop 88. As a result, the filtered signals exit at the output terminal 84 of the filter.

Figure 11:
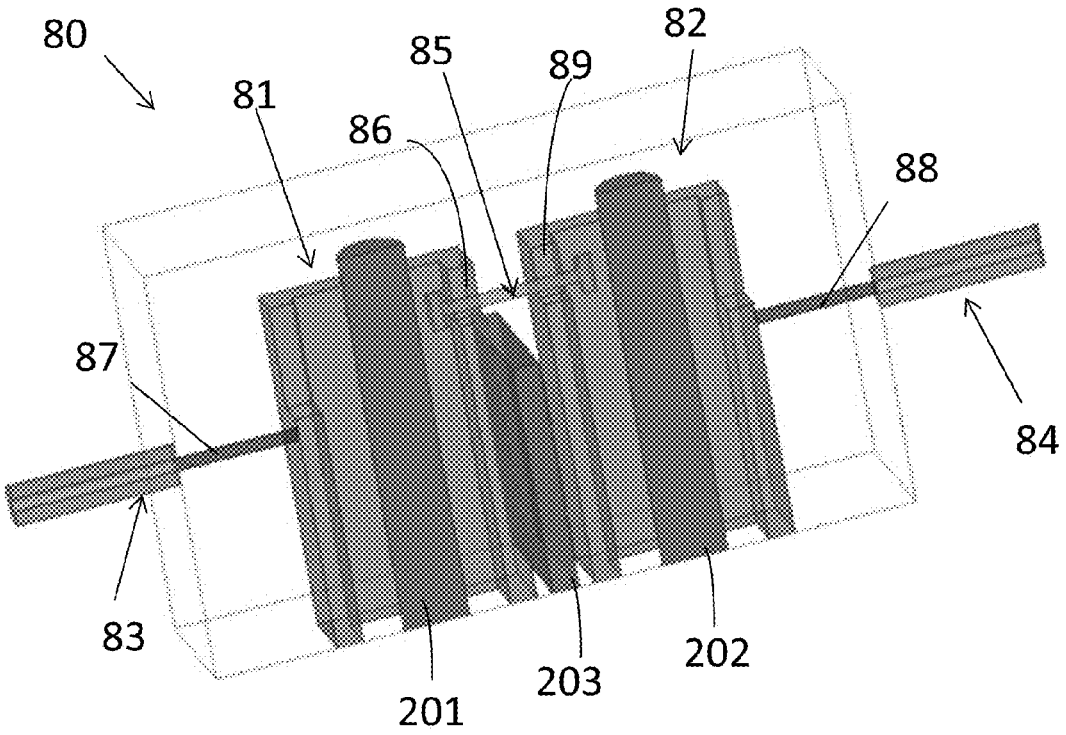
FIG. 11 shows another embodiment for coupling energy between the first and second resonant modes of one cavity to the first and second resonant modes of the adjacent cavity where coupling is achieved through the use of a probe and an iris.

FIG. 11 illustrates a three-dimensional view of half of the structure of a filter 80 to establish coupling of energy between the first and the second resonant modes of one cavity 81 of the dual-band filter to the first and the second resonant modes to the adjacent cavity 82. This is possible through the use of a probe 85 and an iris 86, 89. The probe 85 and the iris 86, 89 are used to control the amount of coupling between the resonant modes of two adjacent cavities 81 and 82, having metallic rods 201, 202, which themselves have the role of controlling the bandwidth of the filter 80. According to filter characteristics and electromagnetic theories, an expert in the field, would recognize that there should be placed dividing walls 203 between certain intermediate walls and metallic rods for obtaining the appropriate coupling values.

Figure 12:
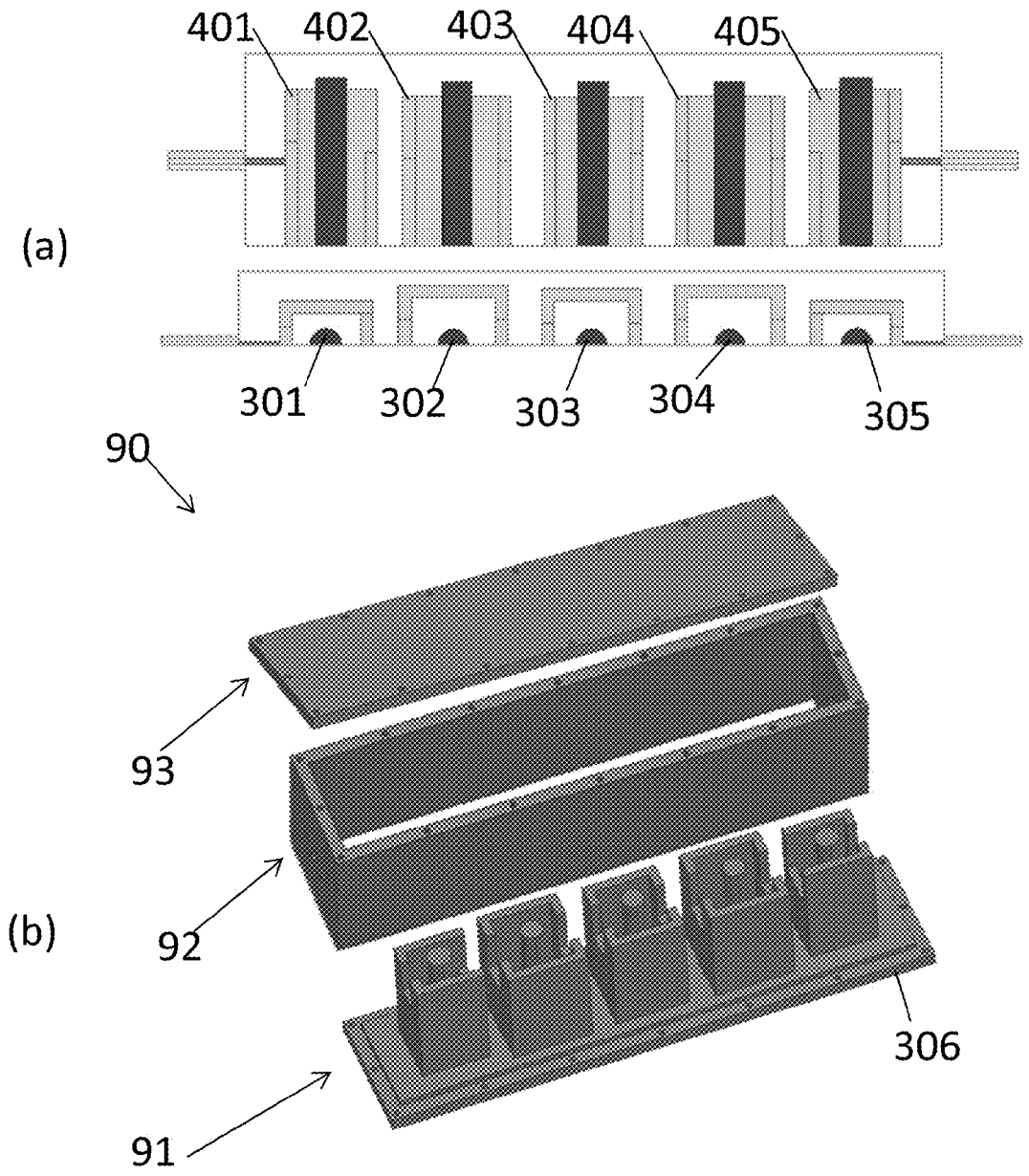
FIG. 12(*a*) shows various views of a $5^{th}$ order dual-band filter consisting of 5 cavities according to the first embodiment of the present invention each operating in two resonant modes to provide the 2 pass bands.

FIG. 12(*a*) shows a side view and a top view of one half of a $5^{th}$ order dual-band filter using the multi-conductor resonators according to the first embodiment of the present invention. There are 5 cavities each operating in two modes to realize the 2 pass bands of the dual-band filer with 5 resonators per pass band. FIG. 12(*b*) also illustrates a manufacturing and assembly approach consisting of three separate parts (a bottom 91, an enclosure 92 and a cover 93). The bottom part 91 has the main elements of the filter including the inner metallic rods 301-305, the intermediate enclosures 401-405 as well as the connecting ground plane 306. The enclosure 92 provides the surrounding walls and is electrically and mechanically connected to the ground plane 306 in part 91. The separate fabrication of parts 91 and 92 allows for the use of simpler mechanical milling machinery. However, the filter 90 can be machined using any other known fabrication and assembly approach. The bottom 93 is electrically and mechanically connected to the enclosure 92 by different ways.

Figure 13:
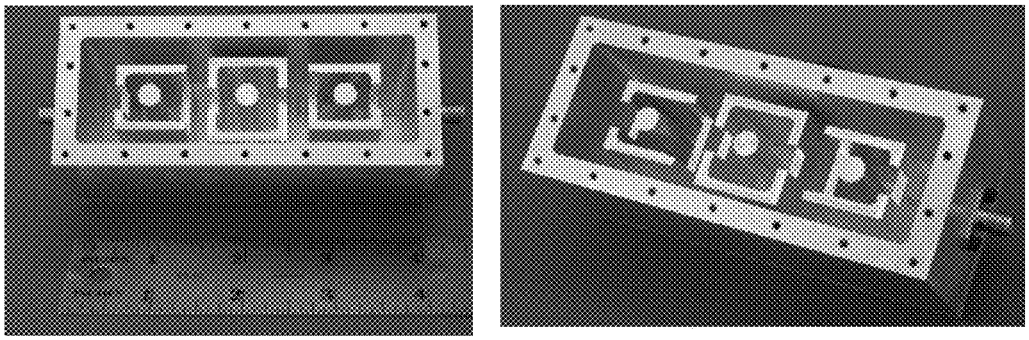
FIGS. 13(*a*)-13(*b*) show pictures of two fabricated dual-band filters: a $3^{th}$ order filter (3 cavities each operating in two resonant modes to provide the 2 pass bands with 3 resonators per pass band) and $5^{th}$ order (5 cavities each operating in two resonant modes to provide the 2 pass-bands with 5 resonators per pass band)
Figure 13:
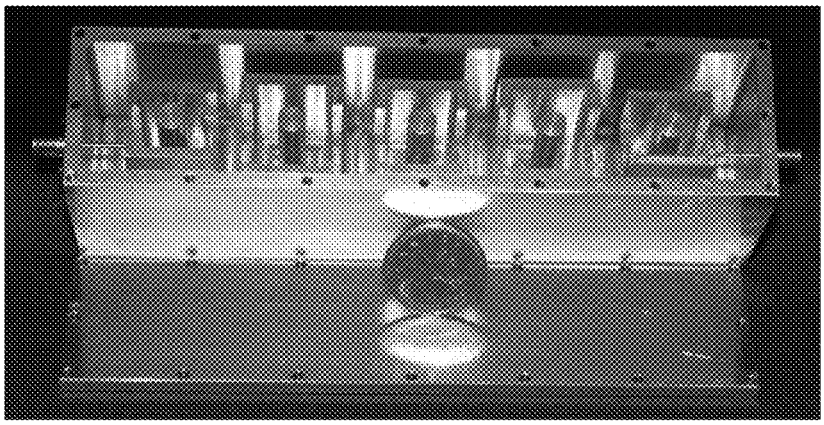

FIG. 13 (*a*) shows pictures of fabricated $3^{th}$ order dual-band filter and FIG. 13 (*b*) shows $5^{th}$ order dual-band filter using the resonators according to the first embodiment of the present invention and the method of construction disclosed in FIG. 12. The filters have been made out of Aluminium, but other metals could be used (brass, copper, etc.).

Using probe, iris and dividing walls between adjacent metallic rods and intermediate walls is optional by the usage of the filter and opinion of a person skilled in the art.

The filters effectively use the triple-conductor combline resonator as the basic building block, exploiting its resonant modes 1 and 2 for making a dual-band filter, where mode 1 in each cavity is resonating in the lower pass-band and mode 2 in each cavity is resonating in the upper pass-band. Moreover, they have increased selectivity due to the transmission zeros (frequency points at which transmission of energy between input and output is totally suppressed) between the pass-bands inherent to the structure presented in this invention.

A considerable amount of research dealing with all aspects of the synthesis problem for dual-band filters has been recently published. Analytical methods and optimization techniques have been presented to reach a coupling matrix fulfilling a desired set of specifications. One common approach is to synthesize two bands in a wideband large order filter, then using transmission zeros in the band to create two distinct pass bands with a guard-band in-between. Although this technique allows the use of any type of resonators, such a concept is bulky since it is almost equivalent of having two filters combined together to construct a dual-band filter. For example, if a $3^{th}$ order dual-band filter is needed for each band, 6 resonators must be used to realize the filter based on this concept. A clear advantage of the triple-conductor combline resonator disclosed in this invention is its compactness. With these resonators, the number of the cavities is reduced to half of the total order of the filter in comparison with conventional dual-band filter designs. In addition, another key advantage of using the triple-conductor combline resonator is that the guard-band selectivity is enhanced by means of the transmission zeros inherent to each cavity, without increasing the order of the filter.

Figure 14:
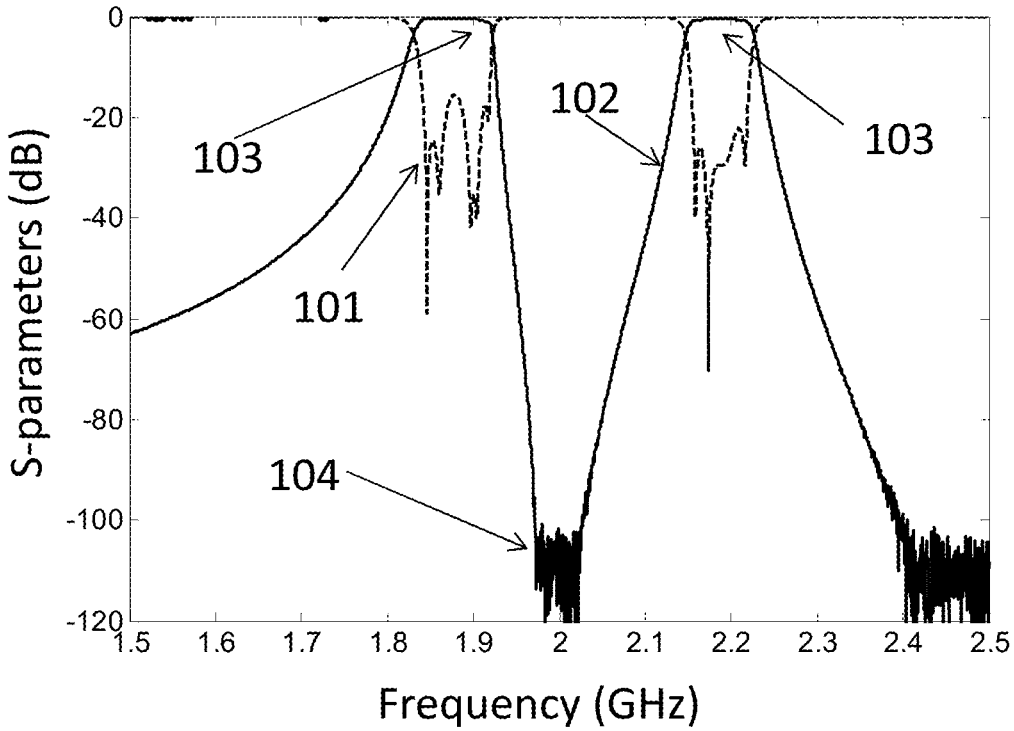
FIG. 14 shows the measured response of a fabricated $5^{th}$ dual-band filter shown in FIG. 13(*b*)

FIG. 14 shows the measured response of the fabricated dual-band $5^{th}$ order filter shown in FIG. 13 (*b*). This plot gives the scattering parameters "S-parameters" of the filter: reflection coefficient 101 in decibels and transmission 102 coefficient in decibels. The filter is a dual-band filter with two pass-bands 103 and shows the transmission zeros 104 between the pass-bands inherent to the resonators of the present invention, leading to a superb selectivity. This is a very important feature of the invention: the high selectivity between the two distinct pass-bands provided by the combline resonators of the present invention.

Figure 15:
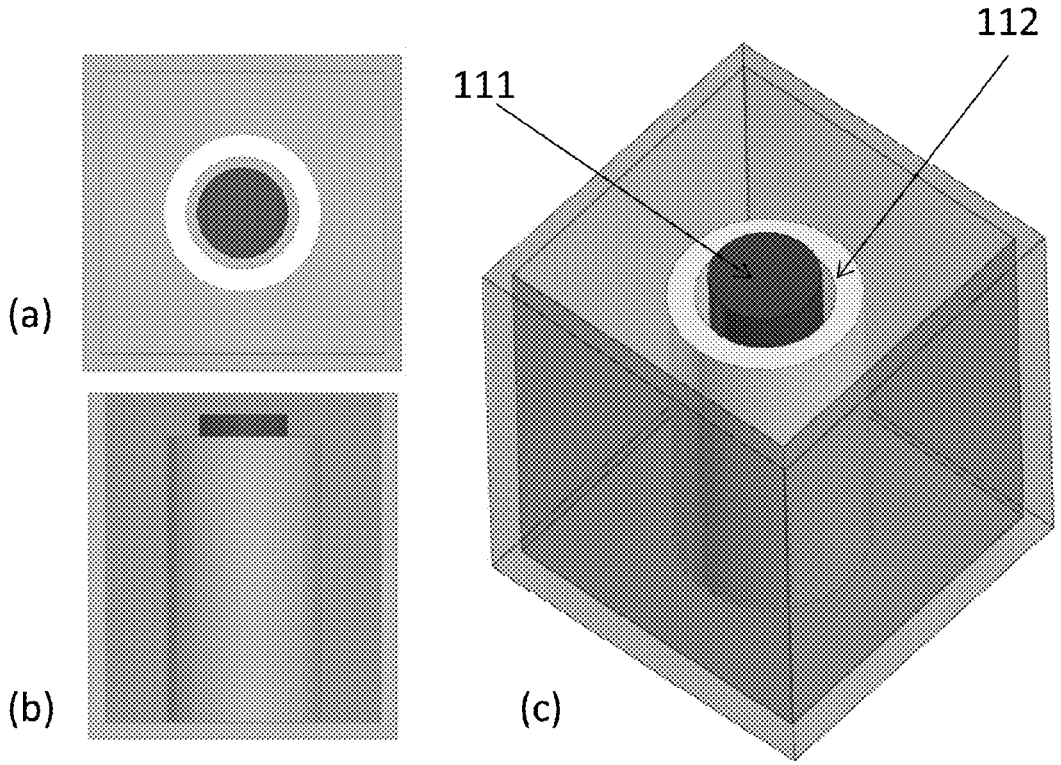
FIGS. 15(*a*)-15(*c*) show a cross-sectional view, side view and 3-dimensional view for a novel resonator according to the second preferred embodiment of the present invention, wherein the inner rod is metallic and intermediate rod is dielectric.

FIGS. 15 (*a*)-(*c*) show a cross-sectional view, a side view and a 3-dimensional view for a novel resonator according to the second embodiment of the present invention. Two types of novel resonators of the second embodiment of the present invention: The inner rod 111 is made of a metallic material while the intermediate cylinder 112 is made of a dielectric material.

Figure 16:
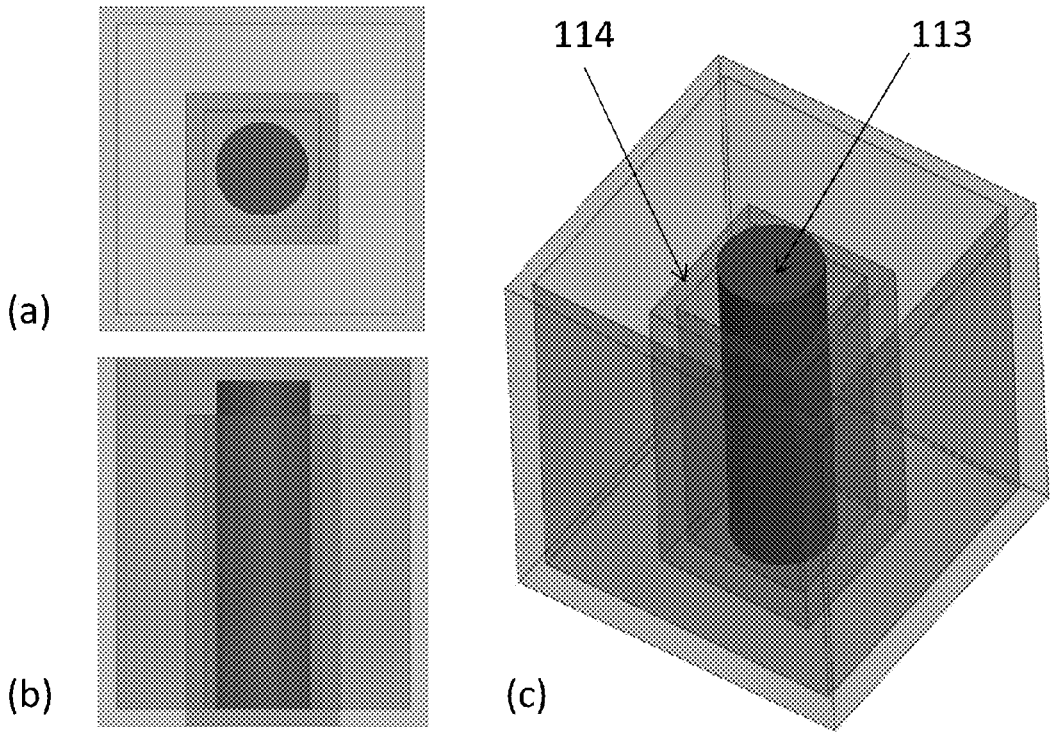
FIGS. 16(*a*)-16(*c*) show a cross-sectional view, side view and 3-dimensional view for a novel resonator according to the third preferred embodiment of the present invention, wherein the inner post is made up of dielectric materials and the intermediate conductor is metallic.

FIGS. 16 (*a*)-(*c*) show a cross-sectional view, a side view and a 3-dimensional view for a novel resonator according to the third embodiment of the present invention. It is made up of an inner rod 113 that is made of a dielectric material and an intermediate wall 114 that is made of a metallic material.

Figure 17:
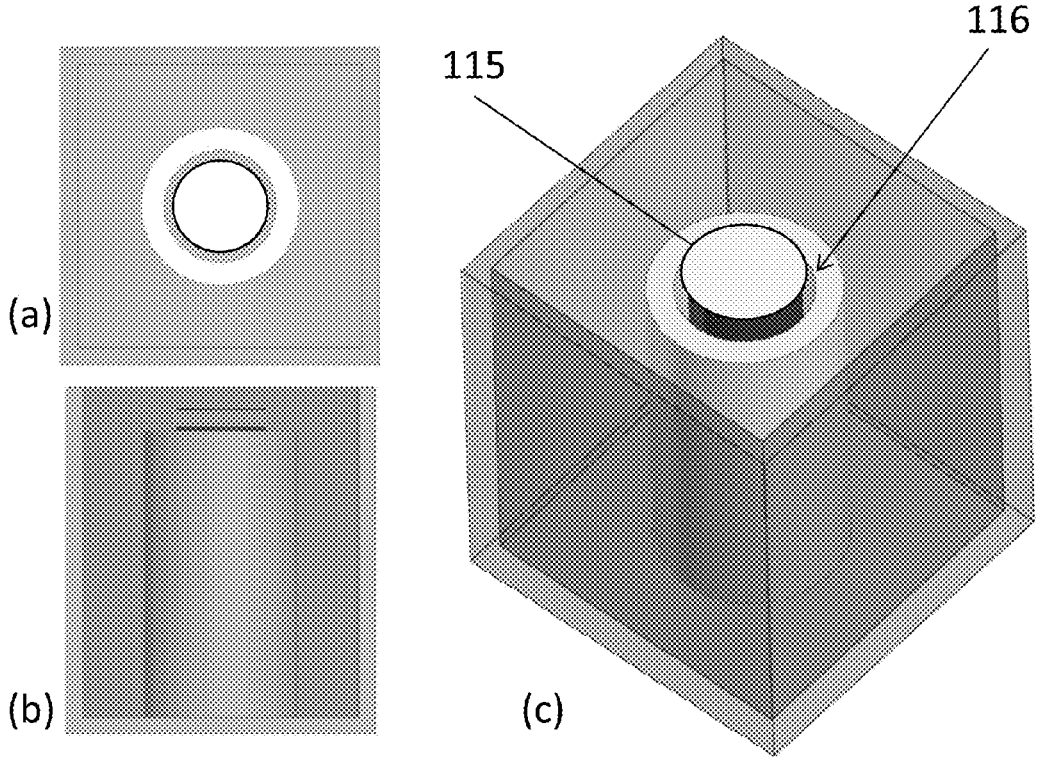
FIGS. 17(*a*)-17(*c*) show a cross-sectional view, side view and 3-dimensional view for a novel resonator according to the fourth preferred embodiment of the present invention, wherein the inner post is made up of dielectric materials and the intermediate conductor is dielectric made from the same dielectric materials of the inner post or from a different dielectric materials.

FIGS. 17 (*a*)-(*c*) show a cross-sectional view, a side view and a 3-dimensional view for a novel resonator according to the fourth embodiment of the present invention. It is made up of an inner rod 115 that is made of a dielectric material and an intermediate wall 116 that is made also of dielectric materials. The dielectric materials of the rod and the intermediate wall could be from the same material dielectric materials or different dielectric materials.

Figure 18:
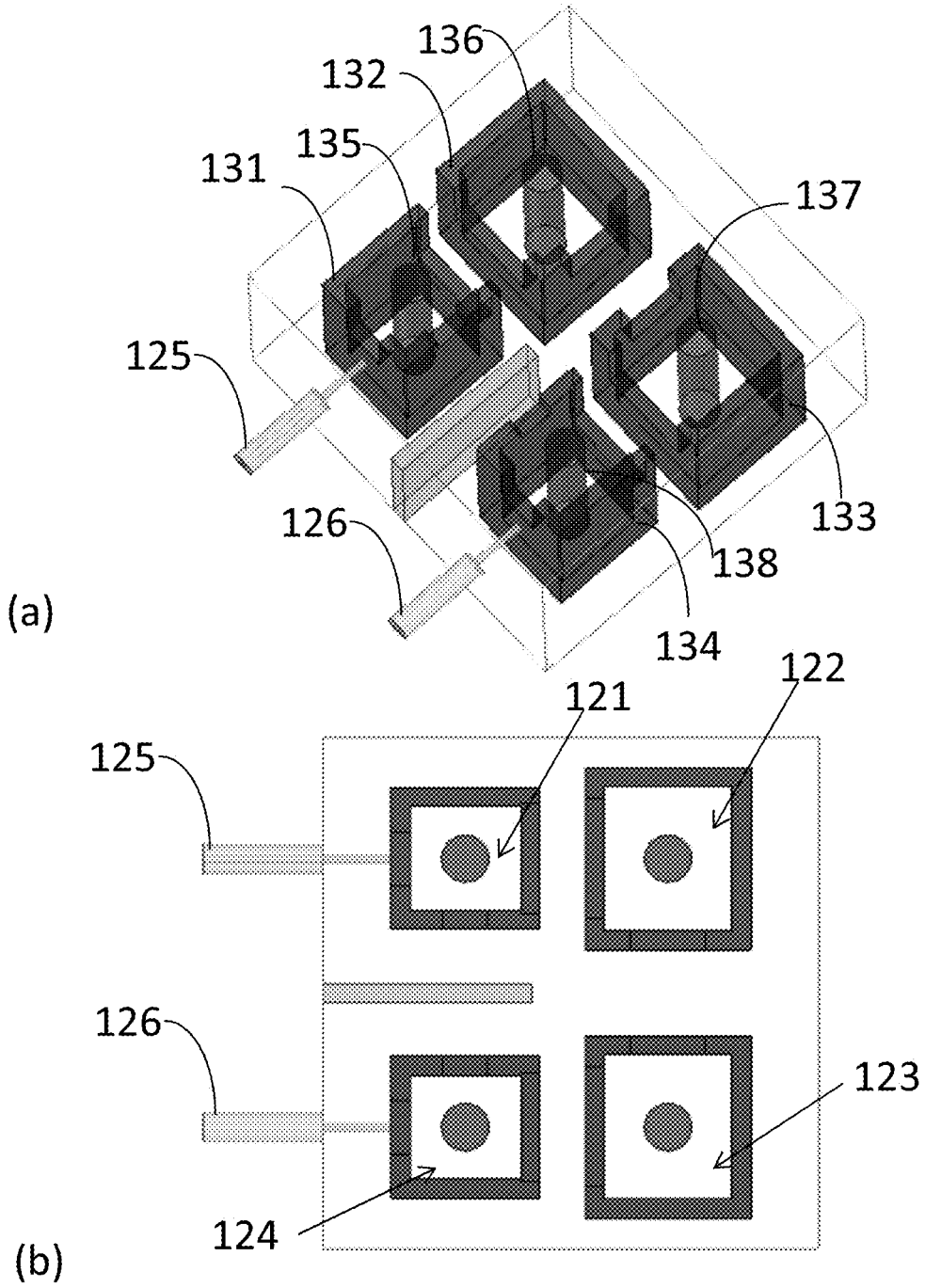
FIGS. 18(*a*)-18(*b*) show a three-dimensional view and top view of a filter with four cavities and eight resonators in canonical configuration for realizing dual-band filters having an elliptic response.

FIG. 18 (*a*) shows a three-dimensional view and FIG. 18 (*b*) shows a top view of a filter with four cavities 121-124 and eight metallic conductors 131-138 in canonical configuration for realizing dual-band filters with an elliptic response. The cavities can be made up of any of the combline resonators of the present invention, as those in the first, second, third and fourth embodiment shown in FIGS. 4, 15, 16 and 17. The structure is folded to allow achieving of non-sequential coupling that is needed to realize elliptic or quasi-elliptic responses. The input/output coupling 125, 126 to the input/output coaxial and the internal coupling between the cavities are done by any of the means in FIGS. 9, 10 and 11.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A radio-frequency/microwave multi-conductor combline resonant structure comprising:

a. a metallic enclosure having a base, a top, a set of walls, said walls having an enclosure height, and an inlet port and an outlet port installed on said enclosure walls;

b. a metallic post having a proximal end, a distal end and a variable post height, said post height being the distance between the distal and the proximal ends, and wherein the proximal end of said post being attached to the base of the enclosure, and the distal end of the post being free;

c. a metallic intermediate shell surrounding said post and placed in between the post and the enclosure walls forming an inner field confinement region between the post and the shell and an outer field confinement region between the shell and the enclosure walls, said shell having a top, a bottom, a shell thickness, shell walls, and a shell height, wherein said shell height being smaller than said enclosure height, and the bottom of the shell being connected to said base; and d. said inner and outer field confinement regions sized to provide two resonant modes being non-synchronous to realize dual-band filters or synchronous to realize dual-mode filters having different operations, and wherein the electromagnetic field pattern inside the resonator is dependent on the relative heights of the inner post and the intermediate shell, as well as the size and shape of the inner and outer field confinement regions.

2. The multi-conductor combline resonant structure of claim 1, wherein said inner and outer metallic shells provide two resonant independent TEM modes.

3. The multi-conductor combline resonant structure of claim 1, further having a coaxial cable coupling, said coupling being tapped into said post and/or said intermediate shell, wherein said coupling being in the form of direct contact tapping or through non-contact tapping.

4. The multi-conductor combline resonant structure of claim 1, wherein said post height being shorter than said shell height, whereby forming a dual mode resonator which first mode fields points in the same direction in both the inner and the outer field confinement regions, and second mode field points in the opposite direction in the inner and outer field confinement regions.

5. The multi-conductor combline resonant structure of claim 1, wherein said post height being longer than said shell height, whereby the electromagnetic field of two modes extending beyond the inner metallic shell.

6. The multi-conductor combline resonant structure of claim 1, wherein said post and said shell having the same height.

7. A radio-frequency/microwave multi-conductor combline resonant structure comprising:

a. a metallic enclosure having a base, a set of walls, and a top, said enclosure having an enclosure height;

b. a plurality of metallic posts attached to said base at a predefined arrangement, each said post having a proximal end, a distal end and a variable post height, said post height being the distance between the distal and the proximal ends, and wherein the proximal end of said post being attached to the base of the enclosure, and the distal end of the post being free;

c. a plurality of metallic intermediate shells, each shell surrounding one said post thereby forming a field confinement region between the post and the shell, each shell having a top, a bottom, shell walls, a shell thickness, and a shell height, wherein said shell height being smaller than said enclosure height, and wherein the bottom of each said shell being connected to said base; and d. said shells having different shell height, shell thickness and openings, designed in order to control the resonant frequency and field pattern of the independent fields of the multi-conductor combline resonant structure.

8. The multi-conductor combline resonant structure of claim 7, further having a plurality of divider-walls, each divider-wall located in between two adjacent shells to improve the characteristic of said multi-conductor and to facilitate proper coupling between adjacent resonant structures when used in a radio frequency filter apparatus.

9. The multi-conductor combline resonant structure of claim 7, wherein each said post, each said shell and said enclosure being circular, rectangular, square or any arbitrary shape.

10. A radio-frequency/microwave multi-conductor combline resonant structure comprising:

a. a metallic enclosure having a base, a set of walls, and a top, said enclosure having an enclosure height;

b. a plurality of metallic posts of arbitrary shapes attached to said base at a predefined arrangement, each said post having a proximal end, a distal end and a variable post height, said post height being the distance between the distal and the proximal ends, and wherein the proximal end of said post being attached to the base of the enclosure, and the distal end of the post being free;

c. a plurality of dielectric intermediate shells, each shell surrounding one said post thereby forming a field confinement region between the post and the shell, each shell having a top, a bottom, shell walls, a shell thickness, and a shell height, wherein said shell height being smaller than said enclosure height, and wherein the bottom of each said shell being connected to said base; and d. said shells having different shell height, shell thickness and opening, designed in order to control the resonant frequency and field pattern of the independent resonant fields of the multi-conductor combline resonant structure.

11. A radio-frequency/microwave multi-conductor combline resonant structure comprising:

a. a metallic enclosure having a base, a set of walls, and a top, said enclosure having an enclosure height;

b. a plurality of dielectric posts of arbitrary shapes attached to said base at a predefined arrangement, each said post having a proximal end, a distal end and a variable post height, said post height being the distance between the distal and the proximal ends, and wherein the proximal end of said post being attached to the base of the enclosure, and the distal end of the post being free;

c. a plurality of metallic intermediate shells, each shell surrounding one said post thereby forming a field confinement region between the post and the shell, each shell having a top, a bottom, shell walls, a shell thickness, and a shell height, wherein said shell height being smaller than said enclosure height, and wherein the bottom of each said shell being connected to said base; and d. said shells having different shell height, shell thickness and opening, designed in order to control the resonant frequency and field pattern of the independent resonant fields of the multi-conductor combline resonant structure.

12. A radio-frequency/microwave multi-conductor combline resonant structure comprising:

a. a metallic enclosure having a base, a set of walls, and a top, said enclosure having an enclosure height;

b. a plurality of dielectric posts of arbitrary shapes attached to said base at a predefined arrangement, each said post having a proximal end, a distal end and a variable post height, said post height being the distance between the distal and the proximal ends, and wherein the proximal end of said post being attached to the base of the enclosure, and the distal end of the post being free;

c. a plurality of dielectric intermediate shells, each shell surrounding one said post thereby confining the field within the post and the shell, each shell having a top, a bottom, shell walls, a shell thickness, and a shell height, wherein said shell height being smaller than said enclosure height, and wherein the bottom of each said shell being connected to said base; and d. said shells having different shell height, shell thickness and opening, designed in order to control the resonant frequency and field pattern of the independent resonant fields of the multi-conductor combline resonant structure.

13. The multi-conductor combline resonant structure of claim 12, wherein each said post and each said shell being made of the same or different dielectric materials.

14. Filters and multiplexers having radio-frequency/microwave multi-conductor combline multiple resonant structures comprising: an enclosure having a base, a set of walls, and a top, said enclosure having an enclosure height; a plurality of posts, each said post having a proximal end, a distal end and a variable post height, said post height being the distance between the distal and the proximal ends, and wherein the proximal end of said post being attached to the base of the enclosure, and the distal end of the post being free; a plurality of intermediate shells, each having a top, a bottom, shell walls, a shell thickness, and a shell height, wherein said shell height being smaller than said enclosure height, and wherein each shell surrounding one said post, thereby forming a field confinement region between the post and the shell, and wherein the bottom of each said shell being connected to said base; said shell walls having shell openings, wherein said shell openings designed to control the resonant field of the combline cavity; and a plurality of probes each probe coupling two adjacent resonant structures.

15. Filters and multiplexers of claim 14, wherein said post and said shell being made of a metallic or a dielectric material.

16. Filters and multiplexers of claim 14, wherein each said post and each said shell being made of the same or different dielectric materials.

* * * * *